United States Patent [19]

O'Rourke

[11] 4,352,217

[45] Oct. 5, 1982

[54] WATER BED BASE

[76] Inventor: Peter W. O'Rourke, 65 Wattle St., Fullarton, South Australia, Australia

[21] Appl. No.: 132,527

[22] Filed: Mar. 21, 1980

[51] Int. Cl.[3] ..... A47C 27/08

[52] U.S. Cl. ..... 5/451; 5/400

[58] Field of Search ..... 5/451, 452, 400, 401, 5/411

[56] References Cited

U.S. PATENT DOCUMENTS

| | | | |
|---|---|---|---|
| 3,735,432 | 5/1973 | Kreten et al. | 5/451 |
| 4,181,990 | 1/1980 | Santo | 5/452 |
| 4,193,151 | 3/1980 | Calleance | 5/452 |
| 4,245,364 | 1/1981 | Calleance | 5/452 |

*Primary Examiner*—Alexander Grosz

*Attorney, Agent, or Firm*—Jay L. Chaskin

[57] ABSTRACT

A water mattress base support having a flat bottom wall of flexible waterproof sheet material and raised sides extending around the periphery of the bottom wall, each of the raised sides being formed by a pocket of flexible waterproof sheet material and resilient bolster or infill means inserted therein, the bottom wall and the peripheral pockets co-operatively defining together a recess the dimensions of which are such that it can accommodate a water mattress.

7 Claims, 5 Drawing Figures

WATER BED BASE

Figure 2:
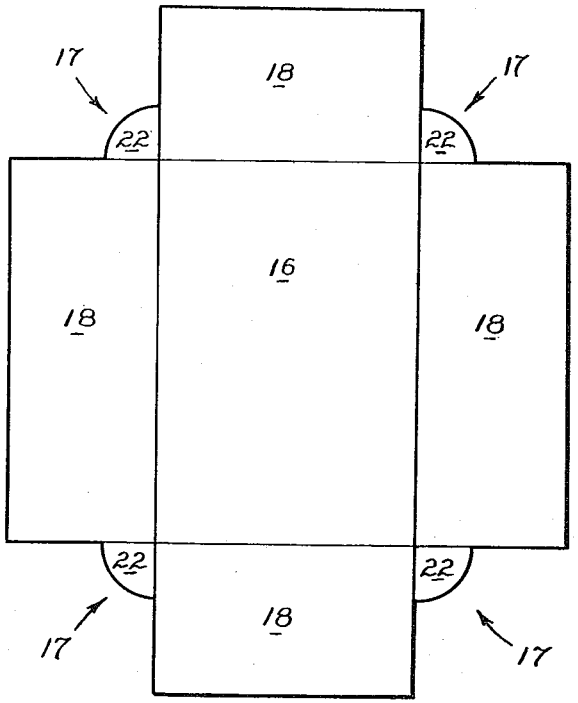

This invention relates to a water bed assembly and in particular to a base frame for supporting a water mattress located therein.

Heretofore, water bed base supporting means usually comprise a rigid rectangular framework of interconnected timber members. Whilst these bed bases have proven relatively satisfactory in use, they suffer from several disadvantages. One such disadvantage is associated with the relative ease and comfort with which a user can climb into or out of the water bed. With known timber frame bed bases, one cannot climb into or out of the water bed without some discomfort to the user owing to the hardness of the timber base support. It will, of course, be realised that on climbing out of a water bed, a marginal portion of the water bed deforms to such a degree (caused by the very nature of the mattress itself) that part of the person's body may bear against the hard timber side. Furthermore, known timber bed bases consist of a number of timber frame members which must be jointed together to form the overall base frame and such a method of manufacture involves separate operations and this is time consuming.

It is the main object of the present invention to provide a water mattress base support frame which obviates the aforementioned disadvantages; namely on which is simple to manufacture and which will not provide any discomfort to a user when climbing into or out of the water bed.

Further to the above, such timber frames are not, by their very nature, capable of retaining water if it should escape from the water mattress and thus require the addition of a waterproof membrane to form a waterproof enclosure for the water mattress such that in the event that water escapes from the mattress it is retained within the frame.

It is a further object of this invention to provide a water mattress support frame which forms a completely waterproof enclosure for a water mattress such that if any water escapes from the water mattress it will be completely retained within the supporting frame i.e. the support frame itself forming a waterproof enclosure without the need for any secondary waterproofing membrane.

It is a still further object of this invention to provide a water mattress support frame which can be made up of components that, when in packaged form, are of such size and weight (as individual packages) that can be easily handled by one person and, as a complete set of packages, (i.e. to form one frame) can be easily transported.

It is a still further object of this invention to provide a water mattress support frame the components of which can be easily assembled by one person and without the use of any tools.

It is a still further object of this invention to provide a water mattress support frame that is capable, as a normal function, to change its aesthetic appearance by the interchange of peripheral fabric decorative covers. The ease with which these covers can be removed and replaced allows them to be laundered and/or interchanged as required.

It is a still further object of this invention to provide a water mattress base support frame which is well insulated and hence assists in maintaining the water temperature of the water mattress by reducing heat losses.

In one aspect of this invention, a water mattress support means comprises a water mattress base having a flat bottom wall formed of flexible waterproof sheet material and a raised side or raised sides extending around the periphery of said bottom wall, the or each side comprising a sleeve of flexible waterproof sheet material and resilient bolster (infill) means inserted therein, said bottom wall and said peripheral sides cooperatively defining together a recess the dimensions of which are such that it can accommodate a water mattress.

In another aspect of the invention, the main body portion and peripheral pocket members are formed from an integral piece of sheet fabric material, preferably reinforced vinyl material, the marginal edge portions of the sheet being folded over to form a hem in which are positioned elongate cores of foam plastics material. The sheet material must have sufficient tensile strength so as to resist tearing during use and should not stretch appreciably.

In another aspect of this invention, a method of forming a water mattress base support frame comprises the following steps:

(1) folding the edges of a sheet of fabric material to return over the material sheet, (2) joining the edges to the material sheet as to form four pockets extending along respective sides of the sheet, and (3) inserting cores of resilient material into said pockets.

It should be realised that the infill material for the peripheral pockets must have sufficient strength so as not to allow the raised sides to flatten out under the pressures exerted thereagainst by the water in the water bed. A suitable material is polyurethane foam having a foam density of between 1.5–3.0 lb/c' and an Indent Load Deflection (I.L.D.) of 25% and 2" sample for 30–80 lbs. load. It is essential that the raised sides locate and retain the water mattress within the recess provided and hence resist substantial deformation under the pressures exerted by the water in the water mattress.

Figure 1:
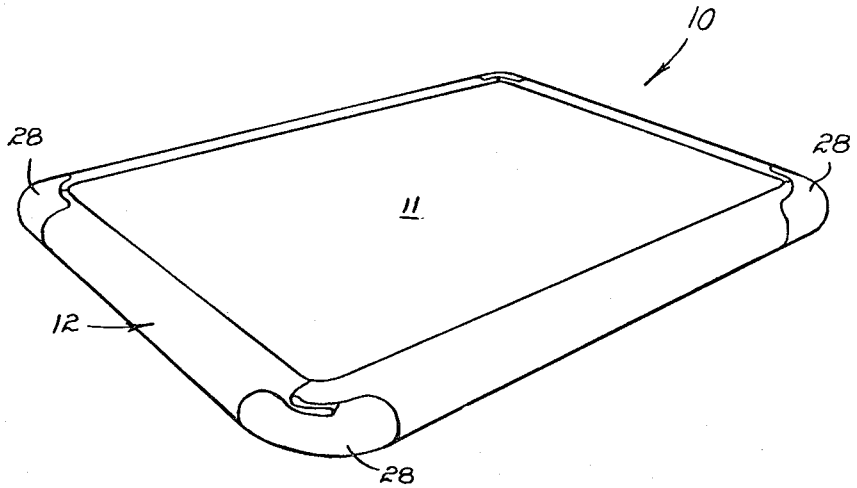
Figure 3:
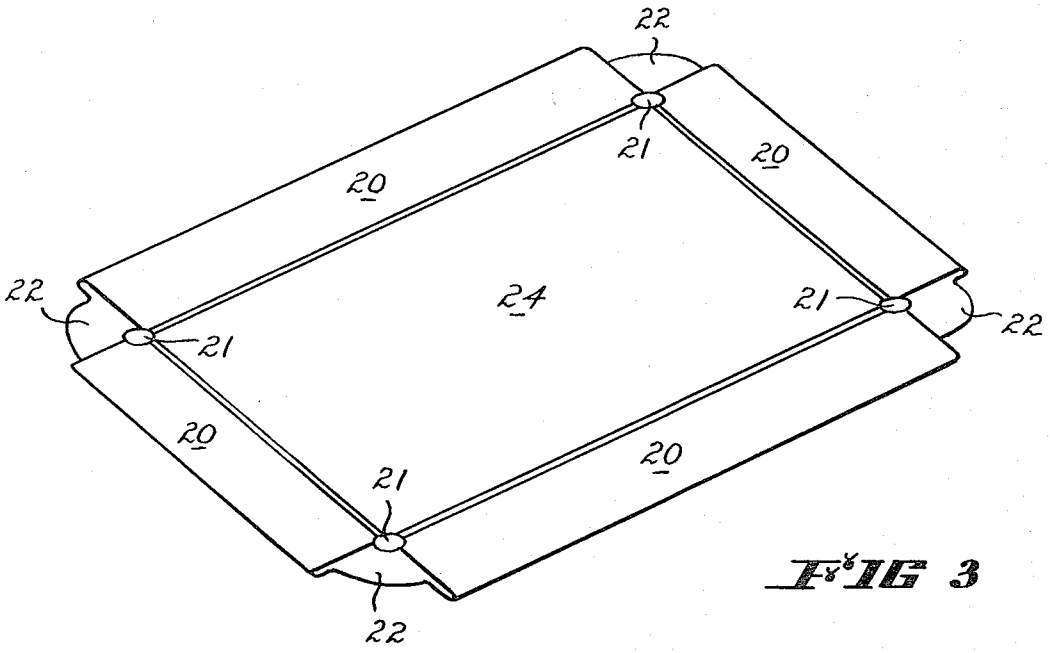
Figure 4:
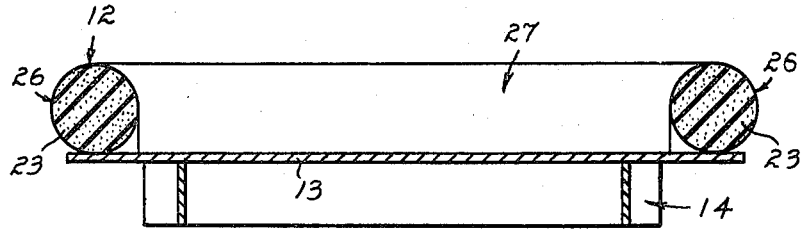
Figure 5:
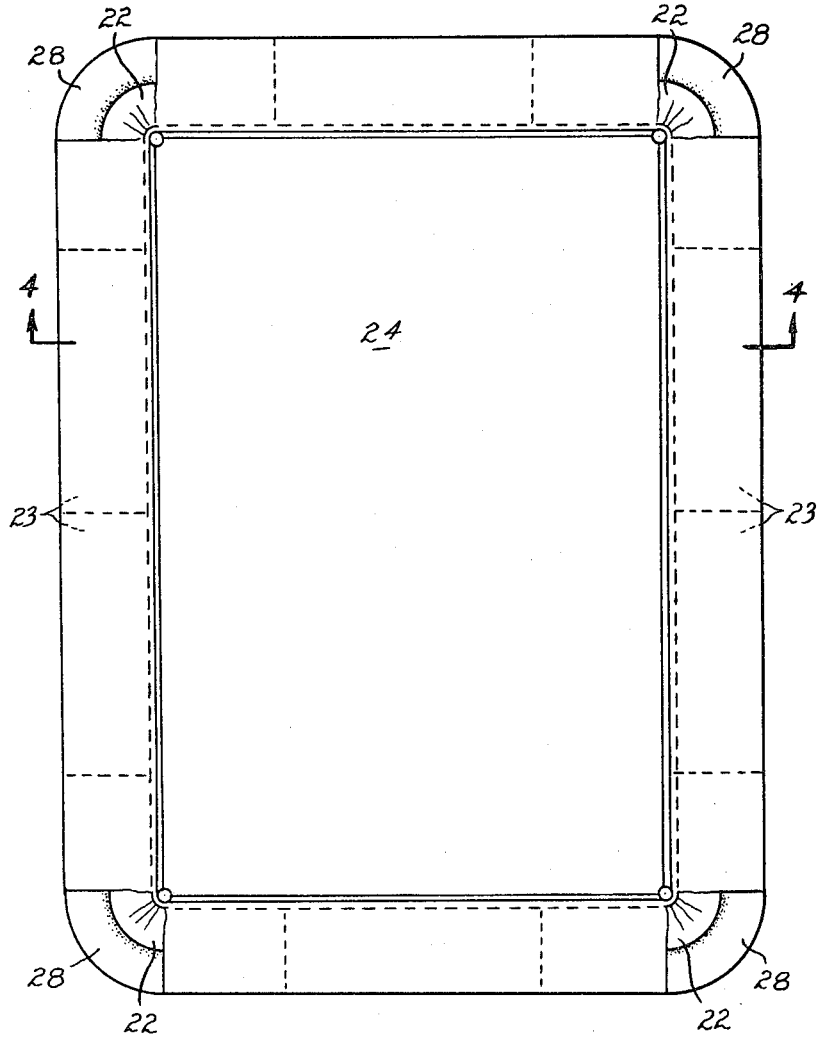

An embodiment of the invention is described hereunder in some further detail with reference to the accompanying drawings in which:

FIG. 1 is a perspective view of a water bed assembly according to the present invention, FIG. 2 is a plan view of part of the base frame in an early stage of manufacture, FIG. 3 is a underneath perspective view of the finished support frame but without the infill or core members (once core members are inserted, whole frame is inverted ready for use), FIG. 4 is a sectional view of FIG. 1, and FIG. 5 is a plan view of FIG. 1 but without the water mattress.

According to this embodiment, a water bed assembly 10 comprises a water mattress 11, a flexible support base 12 for locating and retaining the water mattress 11, a rigid base member 13 for supporting the underside of the support frame 12 and a base stand 14 for supporting the rigid base member 13.

The water mattress support base 12 is formed of flexible waterproof sheet fabric material which in this embodiment is a P.V.C. reinforced fabric (woven polyester scrim with a laminated P.V.C. coating). In this embodiment, as shown in FIG. 2, the base is of substantially rectangular shape and is initially formed from a flat rectangular length of sheet material 16 having cutouts 17 at each of its corners to thereby form a marginal flange 18 along each side of the length of sheet material 16. Each marginal flange or flap 18 is then folded over an equal distance and is secured along its free edge to a respective inner portion of the sheet material 16 by means of a high frequency weld which fuses the two thicknesses of sheet together. In this manner, peripheral hems or pockets 20 and corner flaps 22 are formed of single sheet thickness interposed between adjacent pockets 20 (FIG. 3).

In order to strengthen the corners, corner reinforcing discs 21 of same fabric material as sheet material 16 and of diameter about twice the weld width, are also similarly welded into place. The discs are laid over the contiguous corner edges of adjacent pockets 20 and simply add strength to the construction of the base 12.

A plurality of infill or core members 23 of foam plastics material (polyurethane) are then inserted into each of the peripheral pockets 20. Prior to inserting the elongate core members, the hems or pockets are folded inwardly and creased at the join to thereby form crease or fold lines which define a rectangular area 24 for engaging the underside of a water mattress when positioned therein. By so folding the hems or pockets, the corner flaps 22 are caused to also be lifted from the plane of the support base 12. The hems or pockets 20 with their elongate core members 23 inserted therein, (when placed on a flat rigid surface) form raised or upstanding sides 26 which border the rectangular area 24 defined by the fold lines, the raised sides 26 and area 24 defining together a rectangular shaped recess 27 for receiving the water mattress 11, the depth of the recess approximating to the depth of the water mattress which is placed therein.

Positioned beneath the support base 12 is the base member 13 which is of rectangular shape and formed of particle board, the dimensions of the base member approximating to the dimensions of the underside area of the support frame 12 to thus form a rigid support. The timber base member is itself support by the stand 14.

The water mattress support base 12 is made in the following manner:

The rectangular length of reinforced P.V.C. sheet material 16 is laid out flat. At each corner of the rectangular sheet material, a cutout 17 is made to thereby form four outstanding marginal flaps or flanges 18, and four corner flaps 22 each of which is interposed between a pair of adjacent marginal flanges 18. As described hereinabove, the marginal edge portions are folded over upon themselves, and each has its free edge welded along the respective fold or crease line, by means of a high frequency welding operation, to thereby form the four hems or pockets 20. The elongate core members 23 of foam plastics material are then inserted into the pockets or hems to form a peripheral wall support for the water mattress 11.

With the water mattress 11 positioned in its locating support base 12, due to the weight of the water in the water mattress exerted against the raised sides 26, the pockets 20 and core members 23 are placed in bending, and the corner flaps 22 are curved upwardly to thereby form a complete water-proof receptacle for the water mattress 11 (from which water will not normally leak because of the absence of any join in that surface of the support base 12 engaged by the mattress).

As shown, curved corner core members 28 of foam plastics material are positioned at the corners of the support frame and these provide a support against which the corner flaps 22 engage during use. The ends of the curved corner members 28 are made to engage in spigot-and-socket fashion in the corresponding ends of the peripheral pockets 20.

It will of course be realised that the sheet material support need not be of rectangular shape, but may be oval or circular shape. Furthermore, a decorative cover of fabric material may be placed over the peripheral support member to thereby give a more aesthetic appearance.

A brief consideration of the above embodiment will indicate that the invention is extremely simple, but nevertheless provides a water mattress base frame support, which is of simple construction and relatively low cost, and allows a person to climb into and out of a water bed without any discomfort.

Various modifications in the structure and/or function may be made by one skilled in the art to the disclosed embodiments without departing from the scope of the invention as defined by the claims.

I claim:

1. Water mattress support means comprising a water mattress base having a flat bottom wall formed of flexible waterproof sheet material, raised sides extending around the periphery of the bottom wall, and corner flaps interposed between the sides, each side comprising a sleeve of flexible waterproof sheet material and resilient bolster (infill) means inserted therein, the resilient bolster means comprising corner members, the bottom wall and the peripheral wall sides cooperatively defining together a recess the dimensions of which are such that it can accommodate a water mattress, and the corner flaps engaging against the bolster corner members such that the water mattress base comprises a leakproof receptacle.

2. Water mattress support means according to claim 1 further comprising a rigid base for supporting the whole of the underside of said water mattress base.

3. A water mattress support means according to claim 2 wherein the sides and the bottom are formed from an integral sheet of flexible material.

4. Water mattress support means according to claim 1 wherein the sides and the bottom are formed from an integral sheet of flexible material.

5. A water mattress support means according to claim 1 wherein the sheet material is reinforced vinyl.

6. A water mattress support means according to claim 1 wherein the resilient bolster means is foamed plastic.

7. A water bed assembly comprising:

a rigid base, a mattress support means supported by the base comprising a water mattress base having a flat bottom wall formed of flexible waterproof sheet material, raised sides extending around the periphery of the bottom wall, and corner flaps between the sides, eash side comprising a sleeve of flexible waterproof sheet material and resilient bolster (infill) means inserted therein, the resilient bolster means comprising corner members, the bottom wall and the peripheral wall sides cooperatively defining a recess the dimensions of which are such that it can accommodate a water mattress, the corner flaps engaging against the bolster corner members such that the water mattress base comprises a leakproof receptacle, and a mattress containing water within a flexible wall and carried on the base within the recess and surrounded by the mattress support means.

* * * * *